US007887655B2

(12) United States Patent
Chen

(10) Patent No.: US 7,887,655 B2
(45) Date of Patent: Feb. 15, 2011

(54) FLUID ENVELOPING DEVICE AND METHOD FOR ENVELOPING FLUID WITH THIN FILMS

(76) Inventor: Hui-Mei Chen, No. 52, Beinei St., Shulin City, Taipei County 238 (TW)

( * ) Notice: Subject to any disclaimer, the term of this patent is extended or adjusted under 35 U.S.C. 154(b) by 272 days.

(21) Appl. No.: 11/852,366

(22) Filed: Sep. 10, 2007

(65) Prior Publication Data

US 2009/0065122 A1 Mar. 12, 2009

(51) Int. Cl.
*B32B 37/10* (2006.01)
*B32B 41/02* (2006.01)

(52) U.S. Cl. ..... 156/73.1; 156/286; 156/368; 156/382

(58) Field of Classification Search ..... 156/73.1, 156/286, 368, 382, 145
See application file for complete search history.

(56) References Cited

U.S. PATENT DOCUMENTS 3,755,042 A * 8/1973 Robertson et al. ..... 156/245
4,192,399 A * 3/1980 Otteson et al. ..... 180/170

FOREIGN PATENT DOCUMENTS

GB 2257387 A * 1/1993

* cited by examiner

*Primary Examiner*—Yogendra N Gupta
*Assistant Examiner*—Daniel Lee
(74) *Attorney, Agent, or Firm*—Chun-Ming Shih

(57) ABSTRACT

A fluid enveloping device includes a housing having a vacuum chamber; a valve for blocking off the communication of the vacuum chamber and atmospheric environment; a vacuum pump module connected to the vacuum chamber for extracting air until the vacuum chamber is close to a vacuum state; a die holder for locating a lower thin film and receiving the fluid at the lower thin film; a punch holder for locating an upper thin film; and a sealing nip in the vacuum chamber for hot-pressing the upper and the lower thin films to envelope the fluid therein.

8 Claims, 6 Drawing Sheets

FLUID ENVELOPING DEVICE AND METHOD FOR ENVELOPING FLUID WITH THIN FILMS

CROSS-REFERENCE TO RELATED APPLICATIONS

This application is related to the patent application Ser. No. 11/468,294 filed on Aug. 29, 2006, now U.S. Pat. No. 7,699,953 issued on Apr. 20, 2010 by the same inventor.

BACKGROUND

The present invention relates to an enveloping device and method for enveloping fluid, and in particular to an enveloping device and a method for enveloping fluid under a vacuum environment with hot-press enveloping device.

A conventional method for enveloping silicone gel with plastic films is normally performed in an atmospheric environment, which includes the following steps: firstly, combining two plastic films into a bag like enclosure with an opening by a film welding machine; secondly, pouring silicone gel into the enclosure from the opening to fill the silicone gel with air; thirdly, continuously expelling bubbles and the air out of the enclosure through the opening by manually squeezing the enclosure with the silicone gel; finally, closing the opening by the film welding machine after the bubbles and the air are totally expelled from the enclosure so as to complete the operation of enveloping the silicone gel with the plastic films. However, the above-mentioned conventional method needs to perform two-stage welding procedures and it wastes too much manpower and time. Thus, the manufacturing cost is higher.

Since the enveloping of silicone gel is performed in the atmospheric environment, which leads the problem of the bubbles and the air existed in the enclosure when filling in the silicone gel, additional work has to follow for expelling the bubbles and the air. Such procedure further brings the following extra shortcomings: a poor yield of product; difficult to isolate bacterial contamination; incomplete removal of the bubbles and the air causing separation of the silicone gel from the contact surfaces of the films under an abnormal circumstance, such as during air transportation, which degrades the stability, quality and yield of the product.

For these defects inevitably brought on the prior art, an improvement is seriously required.

The applicant has plunged into the matter for years to studying and improving these defects and come up with a novel method and product of enveloping fluid with films as provided in this invention to eliminate the defects mentioned above.

These features and advantages of the present invention will be fully understood and appreciated from the following detailed description of the accompanying Drawings.

BRIEF SUMMARY

An exemplary fluid enveloping device includes a housing having a vacuum chamber; a valve for blocking off the communication of the vacuum chamber and atmospheric environment; a vacuum pump module connected to the vacuum chamber for extracting air until the vacuum chamber is close to a vacuum state; a die holder for locating a lower thin film and receiving the fluid at the lower thin film; a punch holder for locating an upper thin film; and a sealing nip in the vacuum chamber for hot-pressing the upper and the lower thin films to envelope the fluid therein. The enveloping of the upper and the lower thin films just needs one hot-press enveloping process and no bubbles exist therein.

The fluid can be silicone gel or silicone rubber or high temperature vulcanize (HTV) rubber or their combination.

The die holder can be disposed out or in the vacuum chamber when the fluid is poured thereat. The sealing nip can be located above the punch holder or under the die holder. The sealing nip can operate by hot melting adjoining method, ultrasonic adjoining method or high-frequency adjoining method for hot-press enveloping fluid. In addition, the vacuum pump module includes at least one air vent for extracting air until the vacuum chamber is close to a vacuum state or filling air into the vacuum chamber to relieve vacuum state.

The fluid enveloping device further includes a moving module for driving the die holder to move in and out the vacuum chamber, and further includes at least one lifting module in the vacuum chamber for driving the punch holder and the sealing pin to move down to contact join with the die holder, or at least one lifting module in the vacuum chamber for driving the die holder and the sealing pin to move up to contact join with the punch holder.

Moreover, the fluid enveloping device further includes an operation module, which is used to adjust the all kinds of air pump characteristics of the vacuum pump module or all kinds of hot-pressing characteristics of the sealing nip, and further includes two safety switches, which are pressed simultaneously, the valve can be turned on or turned off.

An exemplary method of enveloping fluid includes: step a: locating an upper thin film at a punch holder; step b: locating a lower thin film at a die holder; step c: pouring a fluid at the lower thin film; step d: sealing a vacuum chamber having the punch holder and the die holder; step e: extracting the air in the vacuum chamber out until the vacuum chamber is close to a vacuum state; step f: driving the punch holder and the die holder to corresponding positions for contact joint; and step g: hot-pressing the peripheral circumferences of the upper and lower thin films for enveloping the fluid therein in a vacuum condition. The enveloping of the upper and the lower thin films just needs once hot-press enveloping process and no bubbles exist therein.

The fluid can be silicone gel or silicone rubber or high temperature vulcanize (HTV) rubber or their combination.

The step of pouring the fluid at the lower thin film can occur within the vacuum chamber or an area outside of the vacuum chamber. The hot-press enveloping method can be hot melting adjoining method, ultrasonic adjoining method or high-frequency adjoining method for hot-press enveloping fluid. After the step g, the method further includes further a step of the vacuum state of the vacuum chamber being released for taking out the enveloped product.

In step f, the die holder can be driven to move up to splice with the punch holder, or the punch holder is driven to move down to splice with the die holder.

In the method, a valve is provided to block off the communication of the vacuum chamber and atmospheric environment in step d. Thus, the method further includes a step of simultaneously pressing two safety switches for turning on or turning off the valve.

BRIEF DESCRIPTION OF THE DRAWINGS

These and other features and advantages of the various embodiments disclosed herein will be better understood with respect to the following description and drawings, in which like numbers refer to like parts throughout, and in which.

DETAILED DESCRIPTION

Figure 1:
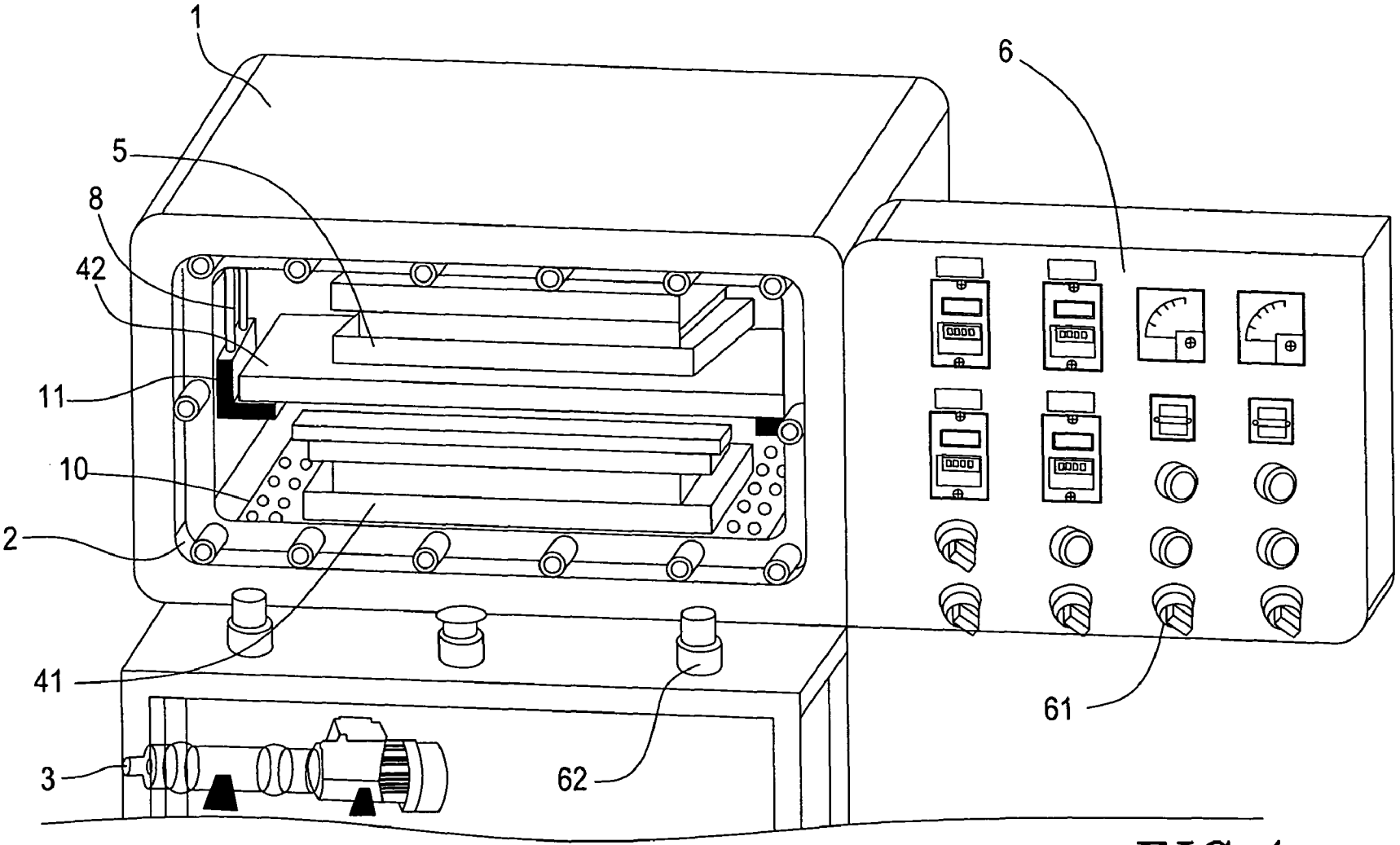
FIG. 1 is a schematic, isometric view of a fluid enveloping device according to a preferred embodiment of the present invention.
Figure 2:
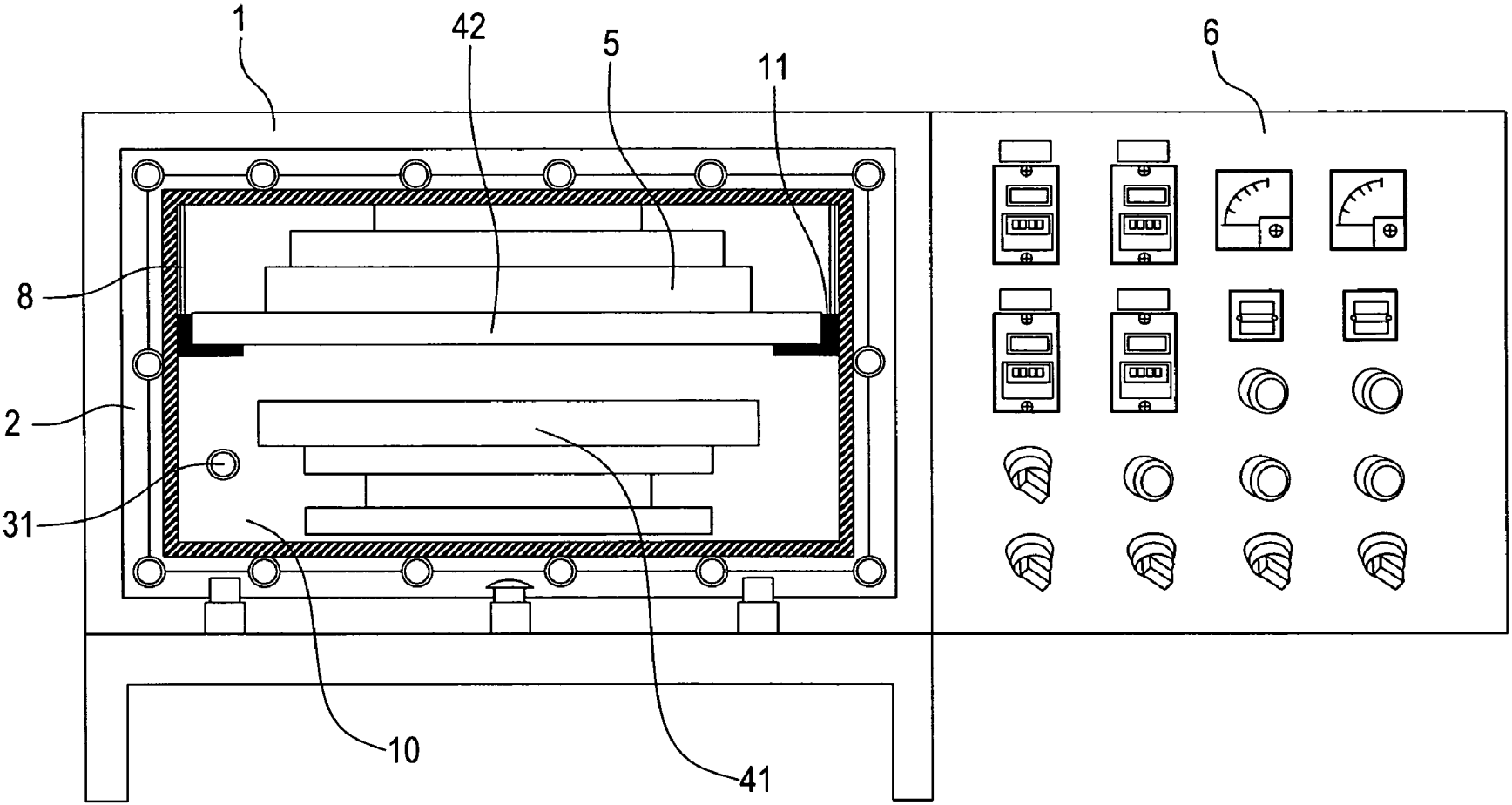
FIG. 2 is plan view from another viewing angle of the fluid enveloping device of FIG. 1.
Figure 3:
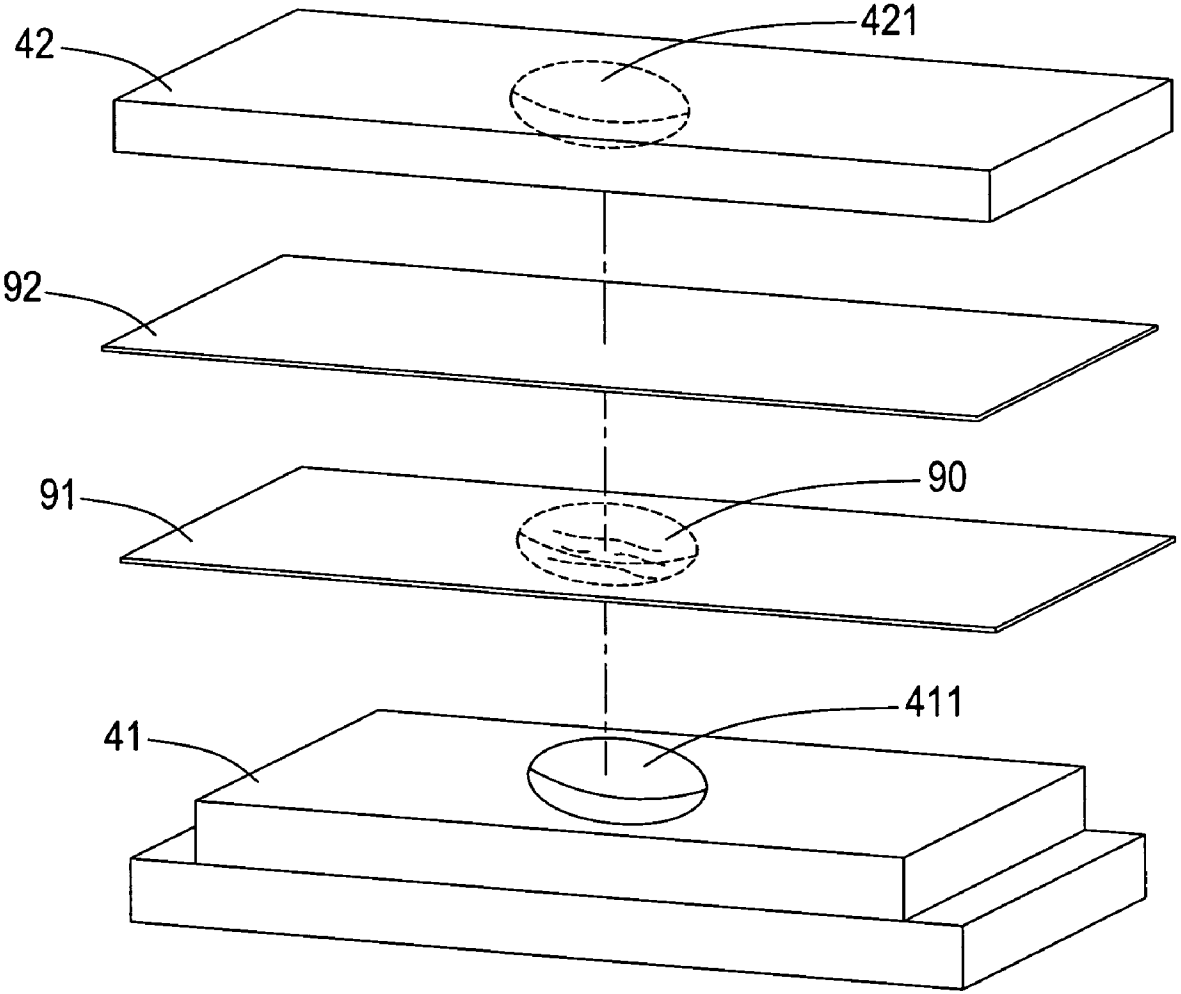
FIG. 3 is a schematic view showing a method for enveloping fluid according to a preferred embodiment of the present invention.
Figure 4:
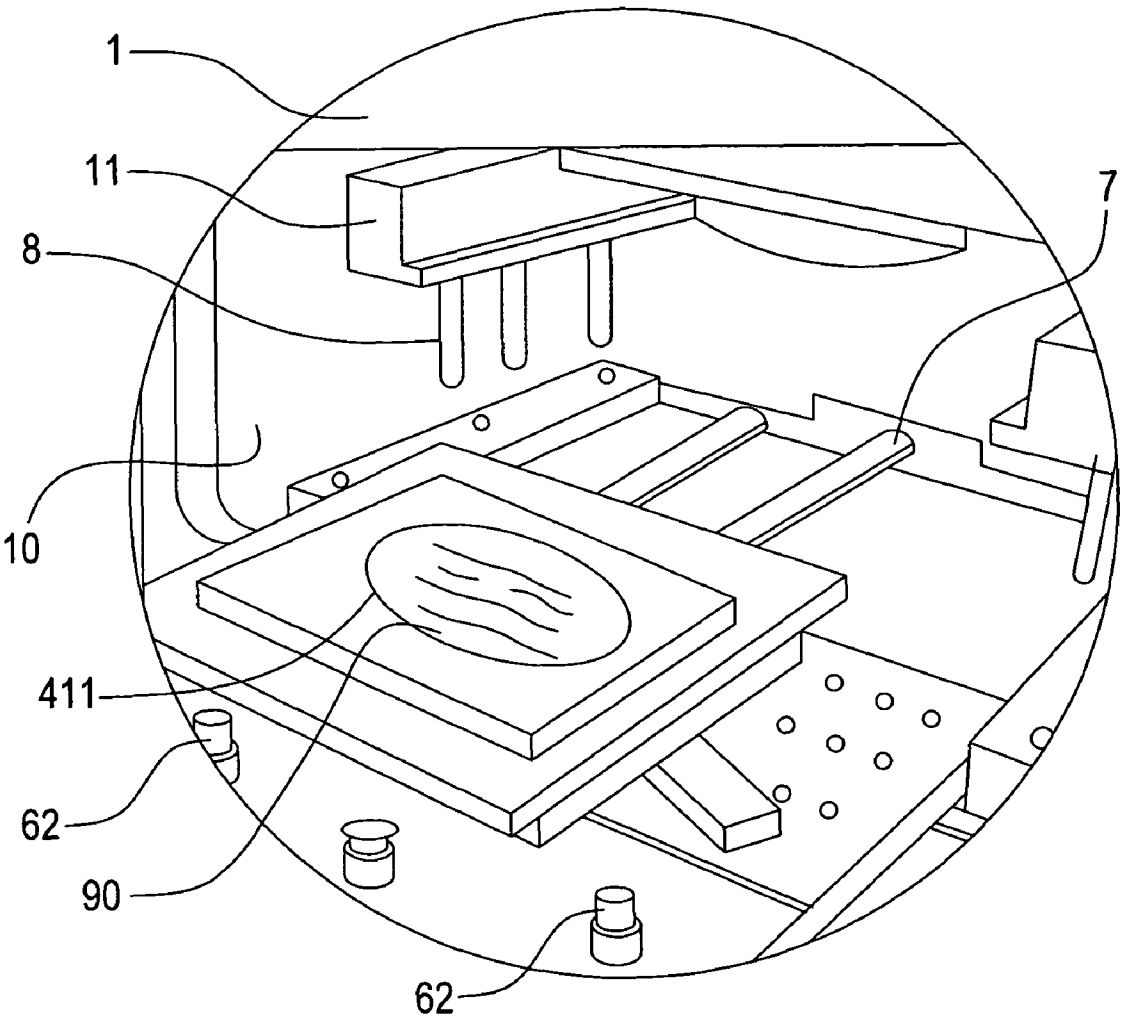
FIG. 4 through FIG. 6 show main steps of the method of FIG. 3.
Figure 5:
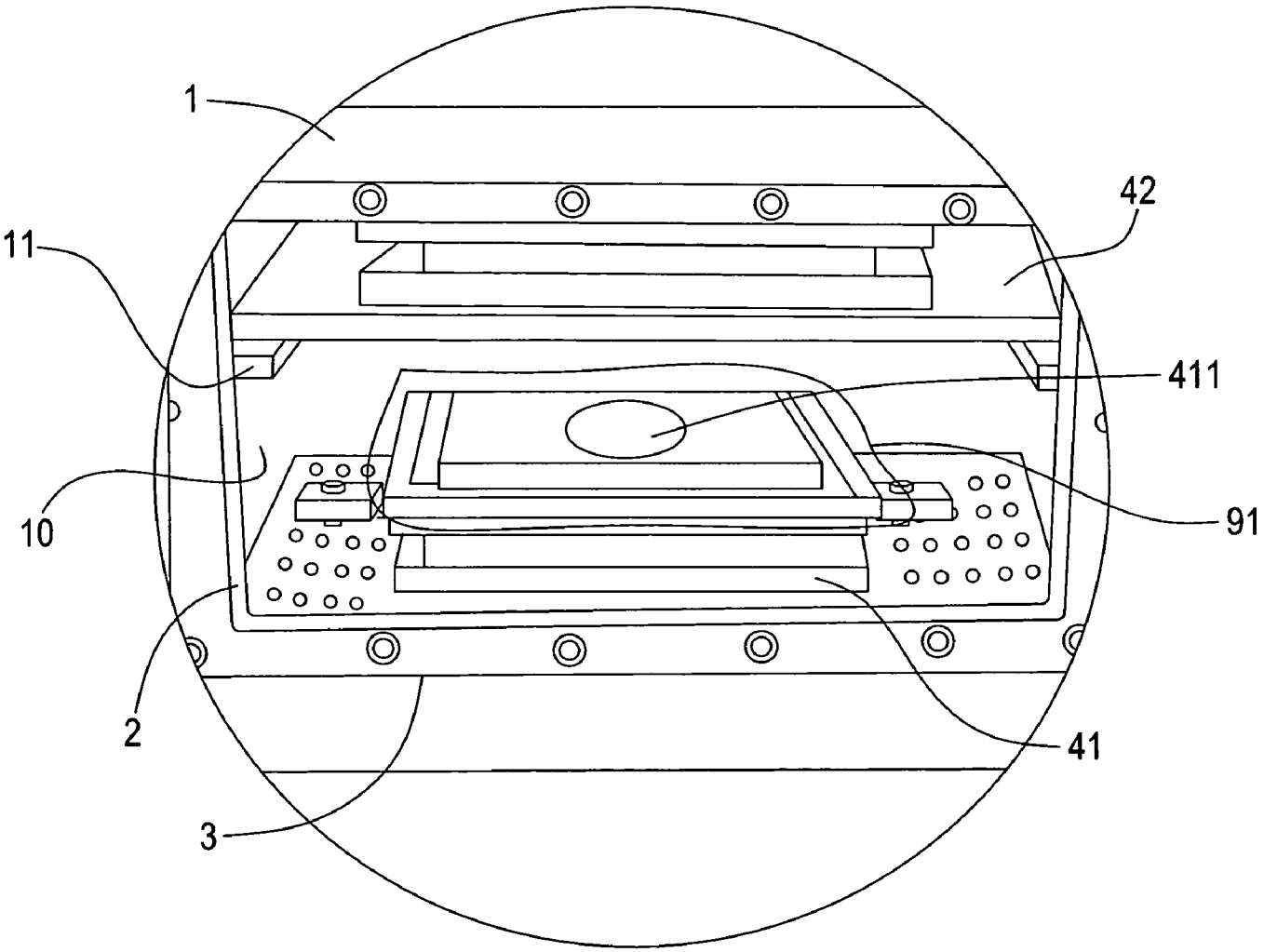
Figure 6:
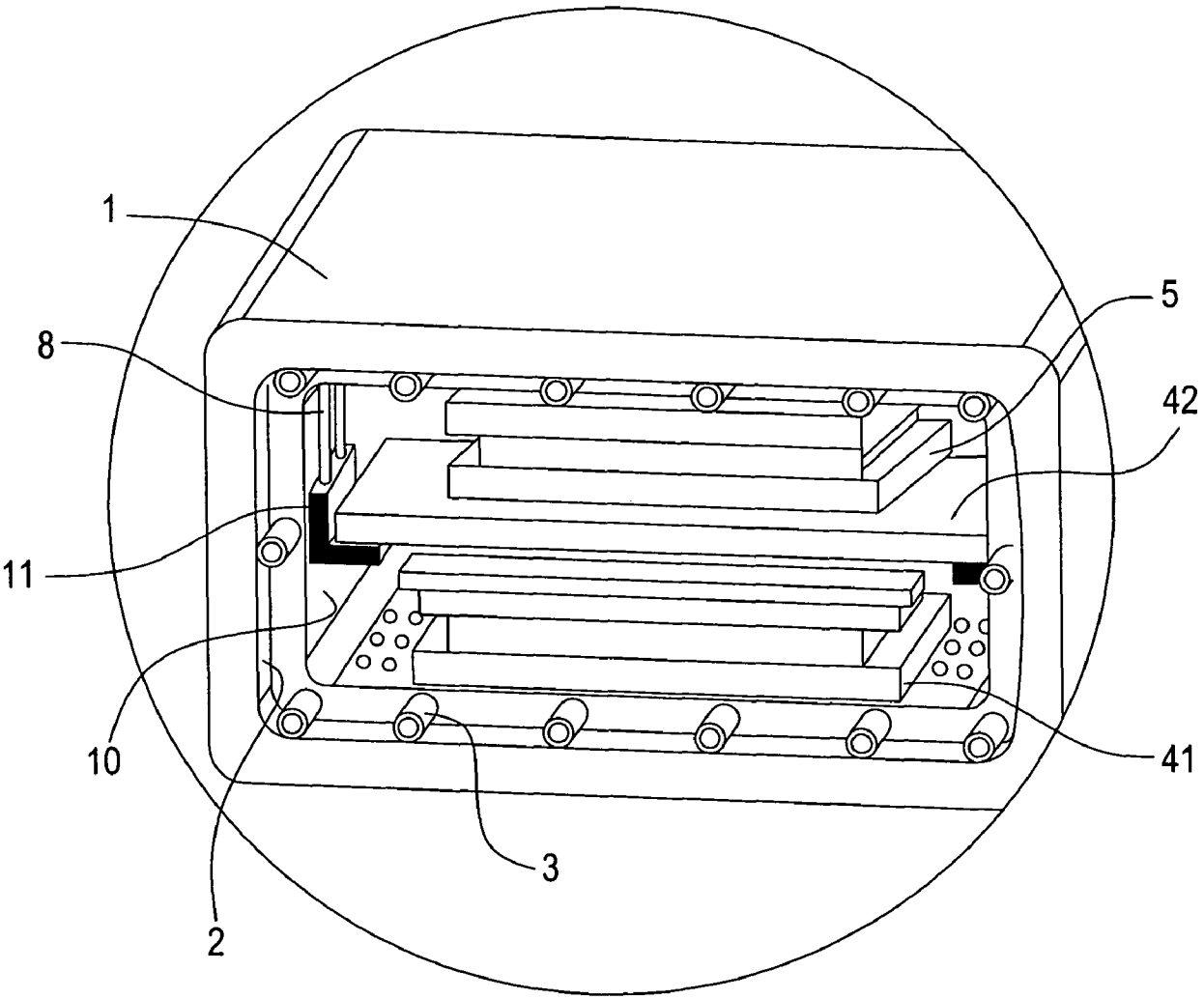

As shown in FIGS. 1 and 2, an enveloping device according to a preferred embodiment of the present invention is disclosed. The enveloping device includes a housing 1, a valve 2, a vacuum pump module 3, a die holder 41, a punch holder 42, a sealing nip 5, and an operation module 6.

The housing 1 is box like configuration, which has a vacuum chamber 10 and a supporting carriage 11 received in the vacuum chamber 10.

The valve 2 is used to seal the housing 1 for closing the vacuum chamber 10 and blocking off the communication of the vacuum chamber 10 and atmospheric environment.

The vacuum pump module 3 connected to the vacuum chamber 10 includes at least one air vent 31 for extracting atmosphere until the vacuum chamber 10 is close to a vacuum state, or filling atmosphere into the vacuum chamber 10 to relieve the vacuum state.

The die holder 41 is disposed outside the vacuum chamber 10, which includes a first die cavity 411. The die holder 41 is used to locate a lower thin film 91 and the fluid 90 is received at the lower film 91.

The punch holder 42 includes a second die cavity 421 for locating an upper thin film 92, which the upper thin film 92 has a peripheral circumference corresponding that of the lower thin film 91.

The sealing nip 5 is disposed on the supporting carriage 11 in the vacuum chamber 10. The sealing nip 5 is used to hot-press the peripheral circumferences of the lower and the upper thin films 91, 92 for enveloping the fluid 90 therein, by a hot melting adjoining method.

The operation module 6 disposed on one side of the housing 1 has a plurality of operating buttons 61 and two safety switches 62. The plurality of operating buttons 61 can be operated by an operator for adjusting the air pump characteristics of the vacuum pump module 3 and hot-pressing characteristics of the sealing nip 5. The two safety switches 62 are used to assure the safe operation of the enveloping device. When the two safety switches 62 are pressed at the same time, the valve 2 can be opened or closed. When the valve 2 is opened, the enveloping device can start up. Thus, the enveloping device can assure an operator safely operating it.

The enveloping device further includes a moving module 7 for driving the die holder 41 to move in and out the vacuum chamber 10, and at least one lifting module 8 in the vacuum chamber 10. The at least one lifting module 8 is used to realize the contact joint of the die holder 41, the punch holder 42, and the sealing nip 5. When one lifting module 8 drives the punch holder 42 to move down or up, another lifting module 8 is provided to drive the sealing nip 5 to move down or up too. In addition, the number of the lifting module 8 can be only one, which can respectively control the movement of the punch holder 42 and the sealing nip 5.

In the above mentioned operation module 6, the adjustable air pump characteristics of the vacuum pump module 3 include the vacuum releasing time, vacuumizing time, and etc. The hot-pressing characteristics of the sealing nip 5 include the hot-pressing time, hot-pressing temperature. In addition, the operation module 6 can turn on or turn off the moving module 7 and control the moving distance of the moving module 7.

Referring to FIGS. 3 through 6, the operator firstly puts the upper thin film 92 in the second die cavity 421 of the punch holder 42, and puts the punch holder 42 on the supporting carriage 11 of the vacuum chamber 10, and then locates the lower thin film 91 on the first die cavity 411 of the die holder 41 and pours the fluid 90 at the lower thin film 91. After the process of pouring fluid is finished, the operator should start the moving module 7 to drive the die holder 41 to move in the vacuum chamber 10 and turn on the valve 2 for sealing vacuum chamber 10 of the housing 1. After that, the operator can utilize the vacuum pump module 3 to extract the air according to the presetting characteristics until the vacuum chamber 10 is close to a vacuum state, where no gas exists in the fluid 90. And then, the operator starts up the lifting modules 8 to drive the punch holder 42 and the sealing nip 5 to move down until the punch holder 42 touches the die holder 41. At the same time, the sealing nip 5 hot-presses the peripheral circumferences of the upper and the lower thin films 91, 92 for enveloping the fluid 90 therein. No bubbles exist in the fluid 90. Finally, the vent hole 31 of the vacuum pump module 3 fills gas into the vacuum chamber 10 to release the vacuum state, and the valve 2 opens the housing 10 to release closing state of the vacuum chamber 10, and the moving module 7 drives the die holder 41 to move out from the vacuum chamber 10. Thus, the hot-press enveloping product can be taken out.

In alternative embodiment, the die holder 41 can firstly be moved in the vacuum chamber 10, and then the fluid 90 can be poured at the lower thin film 91. After that, the operator can utilize the vacuum pump module 3 to extract the air according to the presetting characteristics until the vacuum chamber 10 is close to a vacuum state. In addition, the sealing nip 5 can also be disposed under the die holder 41 for hot-press enveloping the upper and the lower thin films 92, 91.

The method for enveloping fluid with thin films includes the following steps.

Step a: the upper thin film 92 is disposed at the punch holder 42.

Step b: the lower thin film 91 is disposed at the die holder 41.

Step c: the fluid 90 is poured at the lower thin film 91. The step of pouring the fluid 90 can be operated out or in the vacuum chamber 10. If the process of pouring the fluid 90 is operated out the vacuum chamber 10, the moving module 7 drives the die holder 41 in the vacuum chamber 10 after the process is finished. If the process of pouring the fluid 90 is operated in the vacuum chamber 10, the moving module 7 drives the die holder 41 in the vacuum chamber 10 before the process starts up.

Step d: the vacuum chamber 10 having the punch holder 42 and the die holder 41 is sealed. The operator turns on the valve 2 for sealing vacuum chamber 10 and blocking off the communication of the vacuum chamber 10 and atmospheric environment, when the two safety switches 62 are simultaneously pressed down. Thus, the two safety switches 62 assure an operator safely operating it, and prevent the valve 2 from pressing the operator and improve the security.

Step e, the air in the vacuum chamber 10 is extracted out until the vacuum chamber 10 is close to a vacuum state. The operator can utilize the vacuum pump module 3 to extract the air according to the presetting characteristics until the vacuum chamber 10 is close to a vacuum state, where no gas exists in the fluid 90.

Step e, the punch holder 42 and the die holder 41 are driven to corresponding positions for contacting joint. The lifting module 8 drives the punch holder 42 to move down or the die holder 41 to move up for realizing locating the punch holder 42 and the die holder 41 at corresponding positions for contacting joint each other.

Step f, the peripheral circumferences of the upper and lower thin films 92, 91 are hot-pressed for enveloping the fluid 90 therein under a vacuum condition. No bubbles exist thereat. The lifting modules 8 drives the sealing nip 5 to move down for hot-pressing the peripheral circumferences of the upper and the lower thin films 91, 92 and enveloping the fluid 90 therein.

Step g, the vacuum state of the vacuum chamber 10 is released for taking out the enveloped product. After the process of the hot-press enveloping, the vent hole 31 of the vacuum pump module 3 fills gas into the vacuum chamber 10 to release the vacuum state, and the valve 2 opens the housing 1 to release closing state of the vacuum chamber 10, and the moving module 7 drives the die holder 41 to move out the vacuum chamber 10. Thus, the hot-press enveloping product can be taken out.

The fluid 90 is enveloped between the upper and the lower thin films 92, 91 under a vacuum environment without any bubbles and air in the fluid 90 and leak between the two thin films 92, 91. Thus, the fluid enveloping device and the enveloping method do not need a manually squeezing operation for expelling bubbles and the air out of the enclosure through the opening, which can avoid bacterial or others contaminations, and improve the stability of the enveloped product through resolving separation of the fluid from the contact surfaces of the films under an abnormal circumstance. In addition, the operation time, the yield of product can be effectively improved and the cost can be lessened.

In other modifications, the sealing nip 5 can not only operate by hot melting adjoining method, but also operate by ultrasonic adjoining method or high-frequency adjoining method for hot-press enveloping fluid. The fluid 90 can be silicone gel or silicone rubber or their combination.

The above description is given by way of example, and not limitation. Given the above disclosure, one skilled in the art could devise variations that are within the scope and spirit of the invention disclosed herein, including configurations ways of the recessed portions and materials and/or designs of the attaching structures. Further, the various features of the embodiments disclosed herein can be used alone, or in varying combinations with each other and are not intended to be limited to the specific combination described herein. Thus, the scope of the claims is not to be limited by the illustrated embodiments.

What is claimed is:

1. A method of enveloping fluid with thin films comprising the step in sequence of:

step a: locating an upper thin film on a cavity of a punch holder and putting the punch holder in a vacuum chamber;

step b: locating a lower thin film on a die cavity of a die holder, wherein the upper thin film has a peripheral circumference corresponding to that of the lower thin film;

step c: pouring a fluid at the lower thin film after the die holder is moved into the vacuum chamber;

step d: sealing the vacuum chamber having the punch holder and the die holder;

step e: extracting the air in the vacuum chamber out until the vacuum chamber is close to a vacuum state;

step f: driving the punch holder and the die holder to corresponding positions for contact joint of the upper and the lower thin films; and step g: hot-pressing the peripheral circumferences of the upper and lower thin films for enveloping the fluid therein under a vacuum condition.

2. The method as claimed in claim 1, wherein the die holder is driven to move up to contact join the punch holder in step f.

3. The method as claimed in claim 1, wherein the punch holder is driven to move down to contact join the die holder in step f.

4. The method as claimed in claim 1, wherein a valve is provided to block off the communication of the vacuum chamber and atmospheric environment in step d.

5. The method as claimed in claim 4, further comprising a step of simultaneously pressing two safety switches for opening or closing the valve.

6. The method as claimed in claim 1, further comprising a step of the vacuum state of the vacuum chamber being released for taking out the enveloped product.

7. The method as claimed in claim 1, wherein the hot-press enveloping method is hot melting adjoining method, ultrasonic adjoining method or high-frequency adjoining method for hot-press enveloping fluid.

8. The method as claimed in claim 1, wherein the fluid is silicone gel or silicone rubber or high temperature vulcanize (HTV) rubber or their combination.

* * * * *